US008324995B1

(12) United States Patent
Takahama

(10) Patent No.: US 8,324,995 B1
(45) Date of Patent: Dec. 4, 2012

(54) STARTER MAGNET SWITCH AND MANUFACTURING METHOD OF THE SAME

(75) Inventor: Shuichi Takahama, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/427,243

(22) Filed: Mar. 22, 2012

(30) Foreign Application Priority Data

Oct. 13, 2011 (JP) ..... 2011-225624

(51) Int. Cl.
*H01H 63/02* (2006.01)

(52) U.S. Cl. ..... 335/133; 335/131; 335/132

(58) Field of Classification Search ..... 335/126, 335/131–133
See application file for complete search history.

(56) References Cited

FOREIGN PATENT DOCUMENTS

JP 2004-319357 A 11/2004

*Primary Examiner* — Ramon Barrera
(74) *Attorney, Agent, or Firm* — Sughrue Mion, PLLC

(57) ABSTRACT

A starter magnet switch includes: a solenoid; an inner iron core fixed to the solenoid; a plunger attracted to the inner iron core by a magnetic field generated when the solenoid is energized; a rod starting to move when the plunger comes into contact therewith; a movable contact attached to an insulating member loose-fit to the rod; an immovable contact with which the movable contact comes into contact when the rod moves; a contact spring pressing the movable contact against the immovable contact; and a stopper receiving a biasing force of the contact spring via the insulating member, the movable contact, and an insulating washer. The stopper is fixed to the rod by subjecting a tip end of the rod to deformation and caulking. It thus becomes possible to obtain a long-life starter magnet switch by suppressing wear and deformation of parts.

7 Claims, 5 Drawing Sheets

STARTER MAGNET SWITCH AND MANUFACTURING METHOD OF THE SAME

BACKGROUND OF THE INVENTION

1. Field of the Invention

The present invention relates to a starter magnet switch of an engine mounted, for example, on a vehicle, and to a manufacturing method of the same.

2. Related Art

A starter magnet switch converts electrical energy to mechanical energy and opens and closes contacts using the converted energy and a spring incorporated inside. The starter magnet switch feeds energy from a battery to a starter motor portion and interrupts a feeding by opening and closing actions. Patent Document 1 describes a starter magnet switch in the related art.

Patent Document 1: JP-A-2004-319357

Idling-stop vehicles are increasing in recent years and the number of contact opening and closing actions by the magnet switch increases markedly in idling-stop vehicles of a starter method in comparison with vehicles in the related art. According to an apparatus in the related art described in Patent Document 1, in order to fix a movable contact portion, a groove is provided to a rod. The movable contact portion is fixed by inserting a retainer snap into the groove and by holding an outer periphery of the retainer snap with a stopper. This structure requires a clearance between the groove in the rod and the retainer snap at the time of assembly. Hence, when the contacts are opened, that is, when the stopper, the retainer snap, and the rod receive energy from a contact spring, these parts collide with one another and an impact load tends to increase. Naturally, these parts are subject to wear and deformation. It is therefore difficult to apply the disclosed apparatus to idling-stop vehicles adopting the starter method by which the contacts are frequently opened and closed by the magnet switch.

SUMMARY OF THE INVENTION

The invention is devised to solve the problem discussed above and has an object to obtain a long-life starter magnet switch that suppresses a load occurred therein and thereby suppresses wear and deformation of parts by eliminating the clearance descried above.

According to one aspect of the invention, a starter magnet switch includes: a solenoid; an inner iron core fixed to the solenoid; a plunger attracted to the inner iron core by a magnetic field generated when the solenoid is energized; a rod starting to move when the plunger comes into contact therewith; a movable contact attached to the rod; an immovable contact with which the movable contact comes into contact when the rod moves; a contact spring pressing the movable contact against the immovable contact; an insulating member electrically isolating the movable contact from the rod, and a stopper receiving a biasing force of the contact spring via the insulating member, the movable contact, and an insulating washer. The stopper is fixed to the rod by subjecting a tip end of the rod to deformation and caulking.

According to a second aspect of the invention, a method of manufacturing a starter magnet switch is configured in such a manner that the rod of the starter magnet switch configured as above is caulked by rotation motion of a punch against which the rod is pressed.

When configured as above, the clearance is eliminated by pressing the stopper by subjecting the rod to deformation. It thus becomes possible to suppress a force of impact when the insulating washer, the movable contact, and the insulating support member collide with one another when the contacts are opened. Hence, stress occurring in the parts can be reduced and deformation and wear can be suppressed. Consequently, it becomes possible to obtain a long-life magnet switch that is also applicable to an idling-stop vehicle. Also, a retainer snap can be omitted and a work to provide a groove shape in the rod becomes unnecessary. Further, because the rod is subjected to plastic deformation, work hardening occurs in the rod and strength is readily conferred to the rod. In addition, because the rod is caulked by pressing the rod against the riveting punch that is kept rotating, the rod is readily worked. Hence, it becomes possible to use non-magnetic material having a good sliding property, such as brass that does not reduces an attraction force for the plunger, as a material of the rod.

The foregoing and other object, features, aspects, and advantages of the present invention will become more apparent from the following detailed description of the present invention when taken conjunction with the accompanying drawings.

DESCRIPTION OF THE PREFERRED EMBODIMENT

Embodiment

Figure 1:
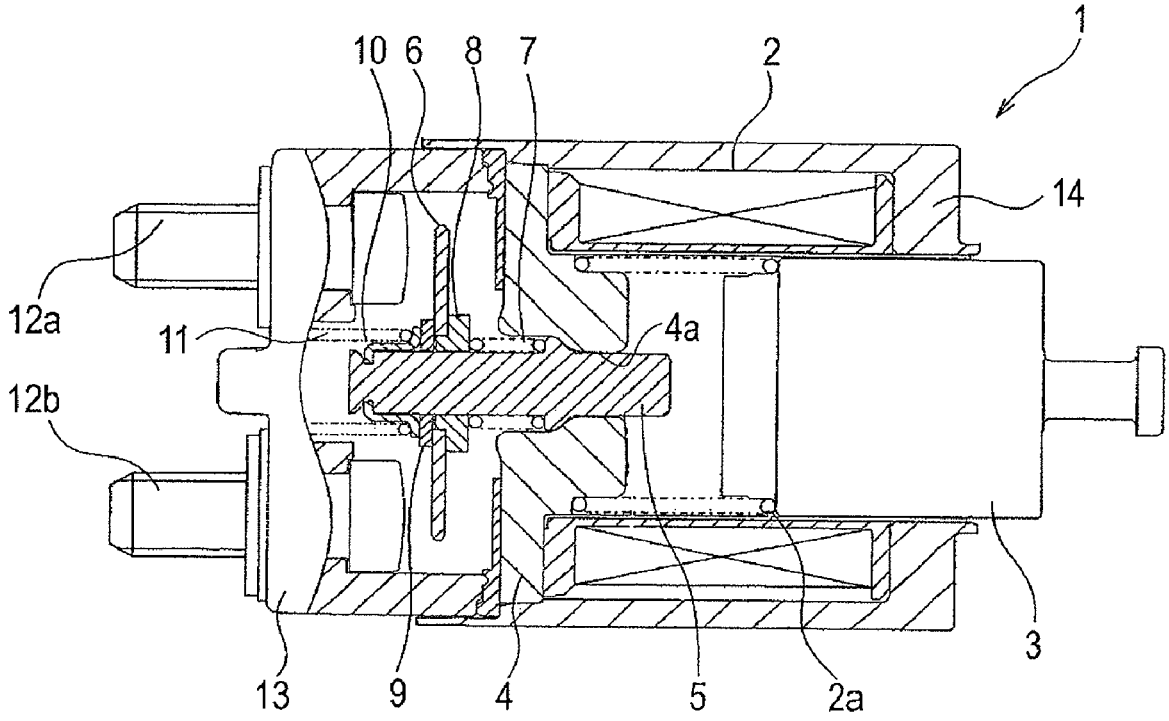
FIG. 1 is a cross section of a starter magnet switch according to an embodiment of the invention.

FIG. 1 is a cross section of a starter magnet switch according to an embodiment of the invention. A starter magnet switch 1 is shaped like a tube opening at one end, and includes a hold case 14 forming a magnetic circuit and a cap 13 made of an insulator and provided to the hold case 14 on the side of the open end. A cylindrically wound solenoid 2 is provided in the hold case 14 and an inner iron core 4 is fit into the hold case 14 at one end of the solenoid 2, that is, on the side of the open end of the hold case 14. The hold case 14 is provided with an opening on the side opposite to the open end and a plunger 3 moving in the solenoid 2 is provided through this opening. When the solenoid 2 is not energized, the plunger 3 is biased by a solenoid return spring 2*a* bridging between the inner iron core 4 and the plunger 3 and stays at a retracted position.

Figure 2:
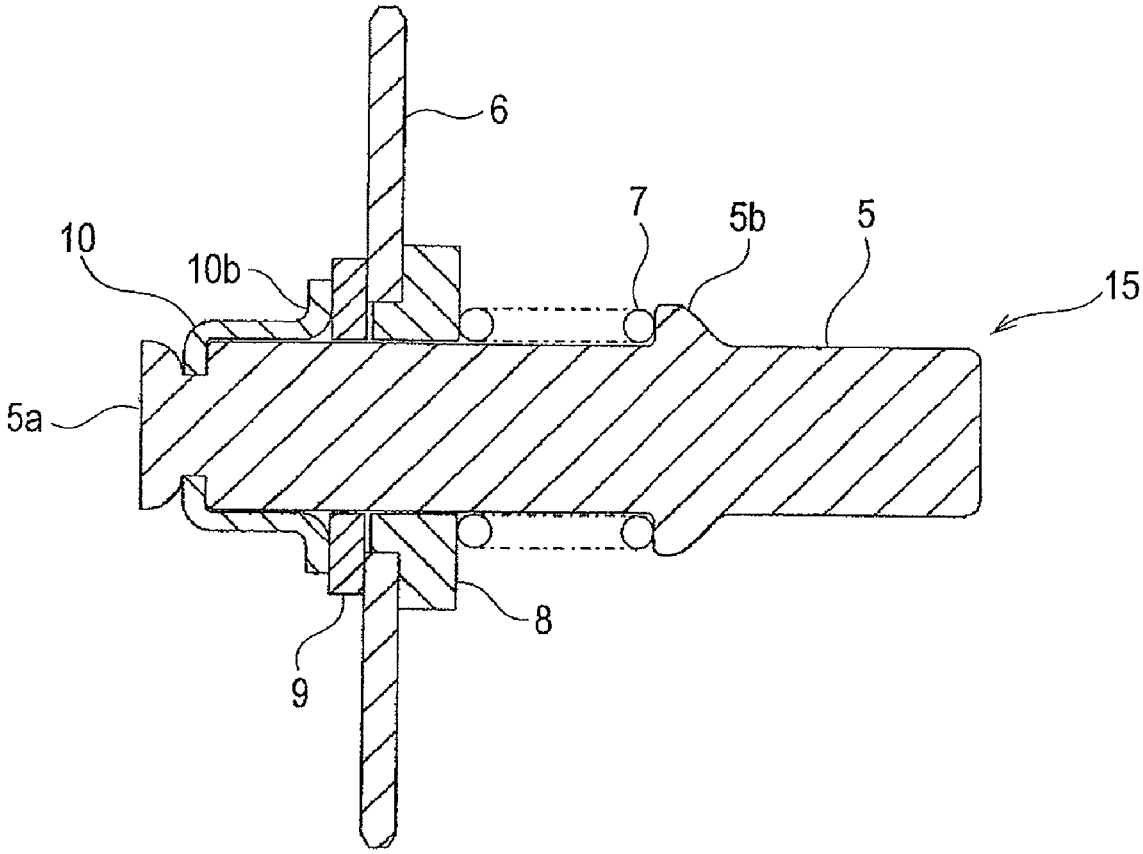
FIG. 2 is a cross section of a contactor assembly of the embodiment.
Figure 3:
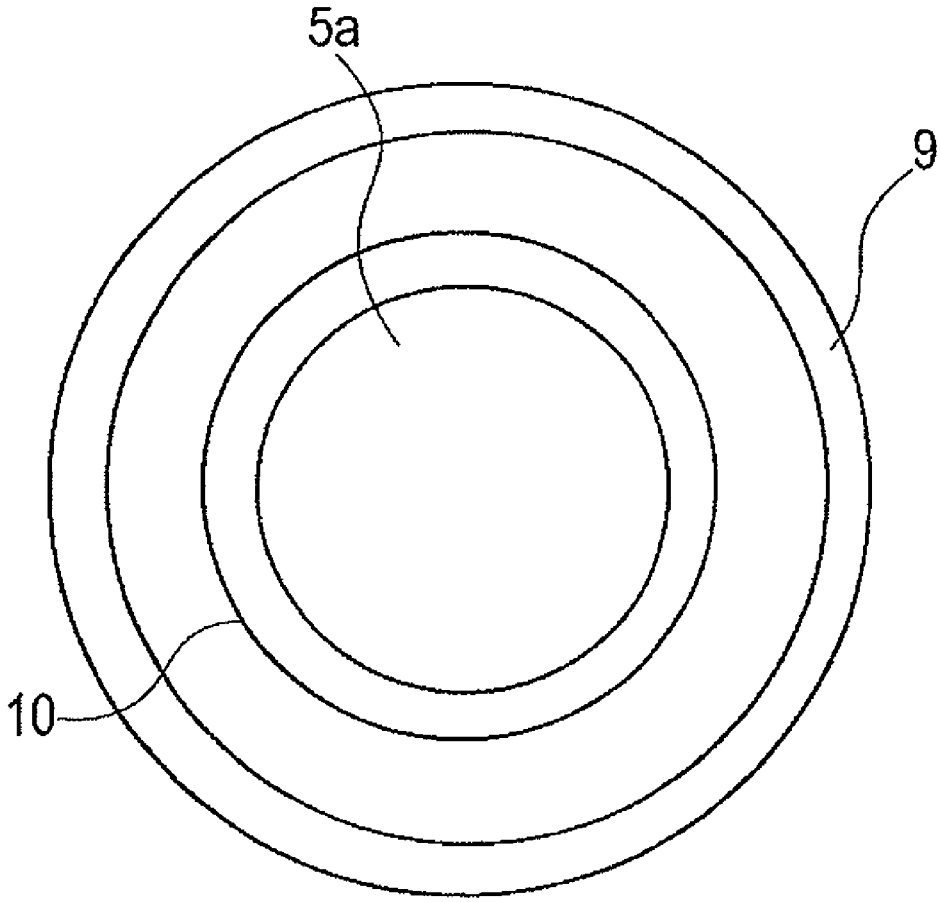
FIG. 3 is a front view of a rod caulked portion of the embodiment.

The inner iron core 4 is provided with an opening 4*a* at a center to hold a contactor assembly 15 shown in FIG. 2 movably in a portion of a rod 5. One end of the rod 5 in the contactor assembly 15 opposes the solenoid 2 and protrudes rearward from a surface of the inner iron core 4. The other end of the rod 5 protrudes within the cap 13. An insulating member 8 loose-fit to the rod 5, a movable contact 6 fixed onto the insulating member 8, and an insulating washer 9 loose-fit to the rod 5 so as to sandwich the movable contact 6 between the self and the insulating member 8 are attached to the portion of the rod 5 protruding toward the cap 13. The rod 5 has a small diameter portion 5*c* (see FIG. 5) with a small diameter at a tip end and a stopper 10 is fit along the small diameter portion 5*c* and fixed by caulking.

Figure 4:
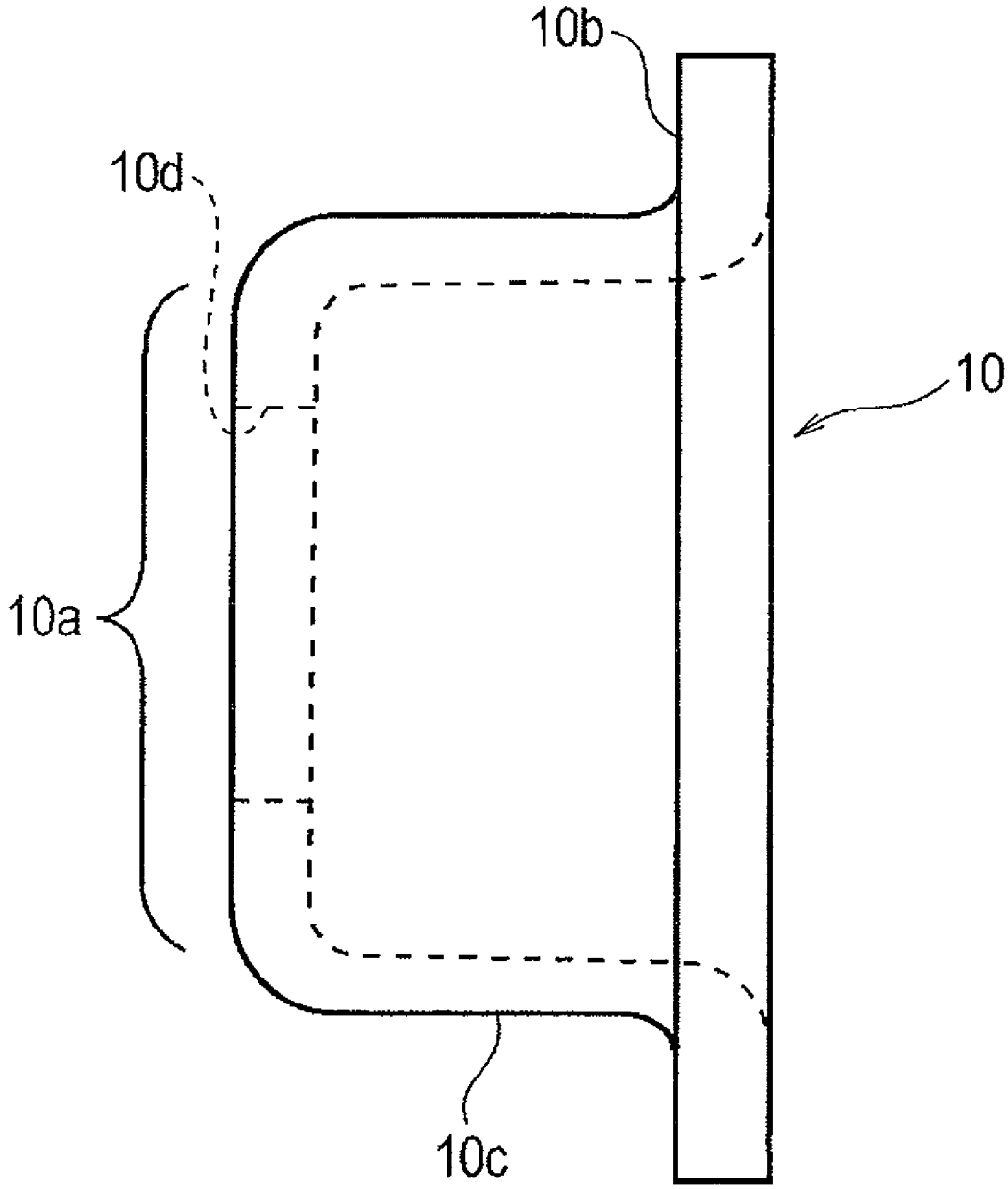
FIG. 4 is a side view of a stopper of the embodiment.

As is shown in FIG. 4, the stopper 10 is a hat-shaped metal material integrally formed of a flat plane portion 10*a* at a top having a circular opening 10*d*, a cylindrical barrel portion 10*c* having an inner diameter as clearance fit with an outer diameter of the rod 5, and a brim 10*b* formed at the bottom of the barrel portion 10*c*. A contact spring 7 is inserted between the insulating member 8 and a protrusion 5*b* of the rod 5 and presses the movable contact 6 forward, that is, against the stopper 10 via the insulating washer 9.

Immovable contacts 12*a* and 12*b* are provided so as to penetrate through a bottom portion of the cap 13. One ends of the immovable contacts 12*a* and 12*b* inside the cap 13 oppose the movable contact 6 and the other ends protrude to the outside of the cap 13 to be connected to unillustrated battery and motor portion. Further, a return spring 11 is inserted between the bottom portion of the cap 13 and the brim 10*b* of the stopper 10 and biases the contactor assembly 15 rearward. The brim 10*b* serves as a hook for the return spring 11 and also as a catch for the insulating washer 9, the movable contact 6, and the insulating member 8. Directions of action of the return spring 11 and the contact spring 7 are opposite to each other. Herein, a biasing force of the return spring 11 is set smaller than a biasing force of the contact spring 7.

An operation will now be described. The solenoid 2 generates a magnetic field upon energization. The plunger 3 is attracted by the generated magnetic field to the inner iron core 4 against a force of the solenoid return spring 2*a* and thus moves forward. The attracted plunger 3 abuts on the rod 5 and biases the rod 5 forward. The movable contact 6, which is provided integrally with the insulating washer 9 and the insulating member 8, moves forward with the rod 5 and comes into contact with the immovable contacts 12*a* and 12*b*, thereby short-circuiting the both contacts. Hence, the immovable contact 12*a* connected to the battery (not shown) and the immovable contact 12*b* connected to the motor portion (not shown) short-circuit. Accordingly, the battery starts to feed the motor portion and the starter starts the engine. After the engine is started, energization of the solenoid 2 is stopped. Hence, the plunger 3 moves backward due to the solenoid return spring 2*a*. The contactor assembly 15 returns to a position where it is present before the operation due to energy of the contact spring 7 and the return spring 11. In the process of returning, the movable contact 6 collides with the insulating washer 9. However, a load occurring at the collision is eventually received by a caulked portion 5*a* of the rod 5.

Figure 5:
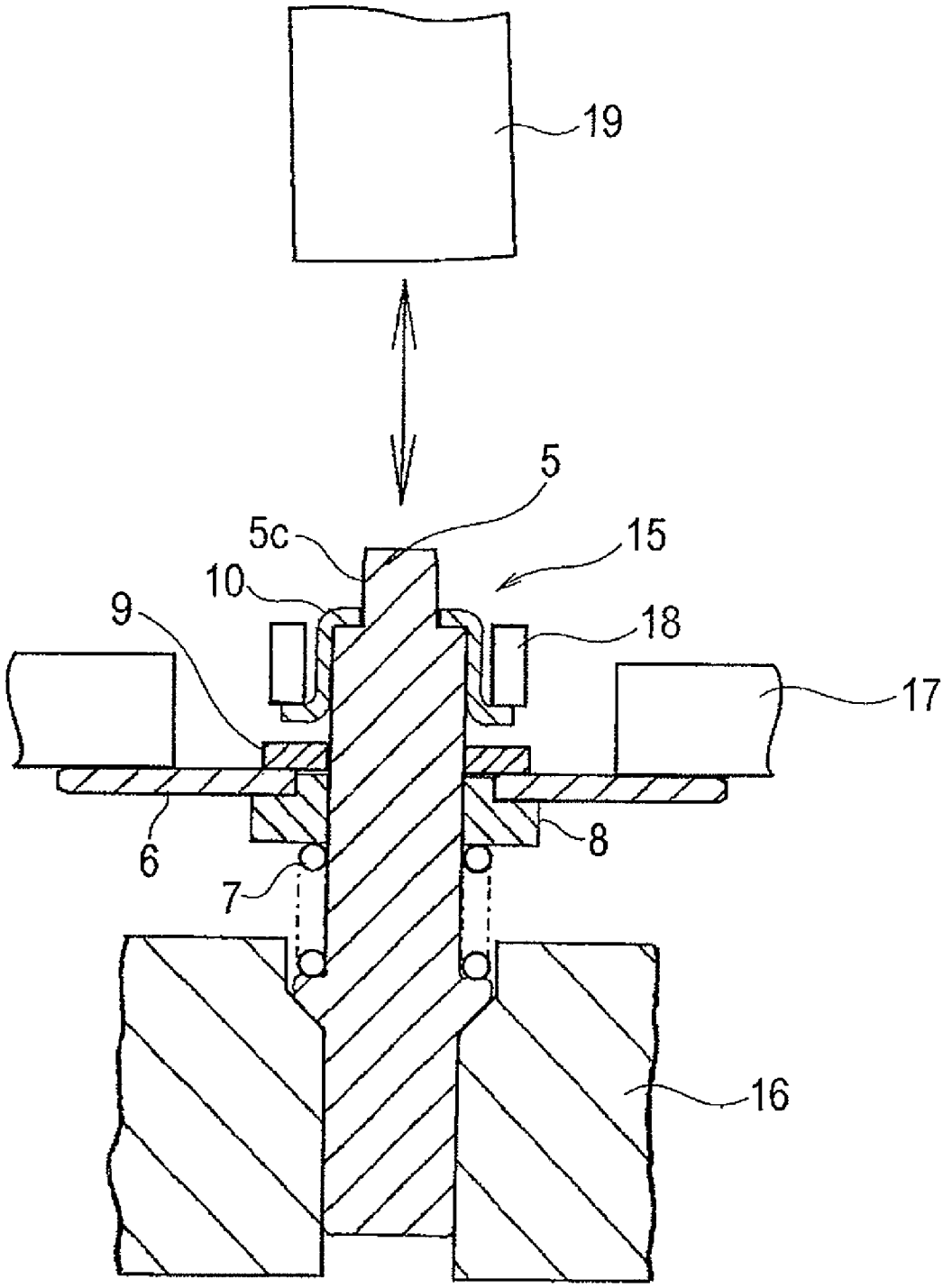
FIG. 5 is a view used to describe rod caulking in the contactor assembly of the embodiment.

A caulking process will now be described briefly. FIG. 5 is a view used to describe rod caulking in the contactor assembly. Referring to FIG. 5, a base portion of the contactor assembly 15 is set to a catch tool 16 first. Subsequently, parts, such as the contact spring 7, the insulating member 8, the movable contact 6, and the insulating washer 9, are attached to the rod 5 from an upper side shown in FIG. 5. Then, the movable contact 6 is pressed by a first pressing tool 17. Further, the opening 10*d* of the stopper 10 is fit along the small diameter portion 5*c* at the tip end of the rod 5. In this instance, the barrel portion 10*c* of the stopper 10 is fit around the rod 5. Subsequently, the brim 10*b* of the stopper 10 is pressed by a second pressing tool 18.

In this state, a riveting punch 19 opposing the tip end of the rod 5 is moved downward while it is kept rotating, and the rotational motion is maintained while the rod 5 is pressed against it. The tip end portion of the rod 5 caulks the stopper 10 with the deformed rod caulked portion 5*a*. At a stage at which predetermined manufacturing conditions are satisfied, the riveting punch 19 is returned upward, and the caulking of the rod 5 is completed. In this instance, because the top of the stopper 10 is the plane portion 10*a*, deformation caused by a radial load received during the caulking can be suppressed in a portion of the stopper 10 pressed by the tip end of the rod 5. Also, because caulking is applied by pressing the rod 5 against the riveting punch 19 while it is kept rotating, the rod 5 can be easily worked. Further, because the rod 5 is subjected to plastic deformation, work hardening occurs in the rod 5 and strength is readily conferred to the rod 5. Hence, it becomes possible to use non-magnetic material having a good sliding property, such as brass that does not reduces an attraction force for the plunger 3, as a material of the rod 5.

Various modifications and alterations of this invention will be apparent to those skilled in the art without departing from the scope and spirit of this invention, and it should be understood that this is not limited to the illustrative embodiments set forth herein.

What is claimed is:

1. A starter magnet switch, comprising:

a solenoid;

an inner iron core fixed to the solenoid;

a plunger attracted to the inner iron core by a magnetic field generated when the solenoid is energized;

a rod starting to move when the plunger comes into contact therewith;

a movable contact attached to an insulating member loose-fit to the rod;

an immovable contact with which the movable contact comes into contact when the rod moves;

a contact spring pressing the movable contact against the immovable contact; and a stopper receiving a biasing force of the contact spring via the insulating member, the movable contact, and an insulating washer, wherein the stopper is fixed to the rod by subjecting a tip end of the rod to deformation and caulking.

2. The starter magnet switch according to claim 1, wherein:

the stopper is of a hat shape integrally formed of a top portion having an opening through which the tip end of the rod is allowed to protrude, a tube-like barrel portion, and a brim formed at a lower end of the barrel portion and abutting on the insulating washer.

3. The starter magnet switch according to claim 2, wherein:

the top portion of the stopper is a plane.

4. The starter magnet switch according to claim 1, wherein:

a cap having the immovable contact is attached to the solenoid and a return spring of the rod is provided to bridge between the cap and the brim of the stopper.

5. The starter magnet switch according to claim 4, wherein:

the return spring has a biasing force smaller than a biasing force of the contact spring.

6. The starter magnet switch according to claim 1, wherein:

the rod is made of a non-magnetic material.

7. A method of manufacturing a starter magnet switch, comprising:

caulking the rod of the starter magnet switch set forth in claim 1 by rotation motion of a riveting punch against which the rod is pressed.

* * * * *